United States Patent [19]

Beaver et al.

[11] Patent Number: 4,913,050

[45] Date of Patent: Apr. 3, 1990

[54] SELF-METERING GRAVITY FED INK DISPENSING ROLLER

[75] Inventors: Robert Beaver, Ft. Wayne, Ind.; Arthur L. Piepmeier, Cookeville; Charles Nunally, Jr., Baxter, both of Tenn.

[73] Assignee: Porelon, Inc., Cookeville, Tenn.

[21] Appl. No.: 247,903

[22] Filed: Sep. 22, 1988

Related U.S. Application Data

[63] Continuation-in-part of Ser. No. 102,866, Sep. 30, 1987.

[51] Int. Cl.[4] ..... B41F 31/14

[52] U.S. Cl. ..... 101/348; 101/367

[58] Field of Search ..... 101/367, 348, 340, 295

[56] References Cited

U.S. PATENT DOCUMENTS

| | | | |
|---|---|---|---|
| 625,861 | 5/1899 | Vail et al. | 101/367 |
| 1,612,936 | 1/1927 | Mitchell et al. | 101/367 |
| 3,336,244 | 8/1967 | Rockoff | 101/367 |
| 3,797,388 | 3/1974 | Kaminstein | 101/367 |
| 3,971,315 | 7/1976 | Hansen | 101/367 |
| 4,246,842 | 1/1981 | Williams | 101/367 |
| 4,416,201 | 11/1983 | Kessler | 101/367 |

FOREIGN PATENT DOCUMENTS

| | | | |
|---|---|---|---|
| 602027 | 12/1925 | France | 101/367 |

*Primary Examiner*—David A. Wiecking
*Assistant Examiner*—Joseph R. Keating
*Attorney, Agent, or Firm*—Foley & Lardner

[57] ABSTRACT

An ink dispensing roll comprises a generally cylindrical member having a plurality of holes communicating with an interior annular reservoir and a microporous ink impregnated sleeve mounted about the cylindrical member. The annular reservoir is in liquid communication with a larger reservoir charged with ink that flows by gravity into the annular reservoir and then into the microporous sleeve.

13 Claims, 1 Drawing Sheet

SELF-METERING GRAVITY FED INK DISPENSING ROLLER

RELATED APPLICATION

This application is a continuation-in-part of our application Ser. No. 102,866 filed on Sept. 30, 1987 and entitled Self-Metering Gravity Fed Ink Dispensing Roller and assigned to the same assignees as the present application.

FIELD OF THE INVENTION

This invention relates to an ink dispensing roll for the transfer of ink in a printing apparatus and more particularly to an ink dispensing roller assembly for the precise metering and transfer of ink for the printing of high quality, optically readable characters such as scannable and verifiable bar codes.

BACKGROUND OF THE INVENTION

The prior art is replete with descriptions of ink dispensing rolls with ink metering features. U.S. Pat. No. 4,458,399 issued July 10, 1984 to Kessler describes the use of a horizontally mounted roll comprised of plurality of coaxially mounted, spaced discs positioned within and press fitted against a perforated tube about which a sleeve of porous material is fitted. The spaced discs define a plurality of chambers which hold ink and permit the flow of ink through the perforations of the tube and into the sleeve. U.S. Pat. No. 4,399,751 issued Aug. 23, 1983 to Kessler discloses still another ink dispensing roller having a plurality of axially aligned thin discs wherein each disc has a series of circumferential grooves and axial grooves. The discs are covered by a porous sleeve. Ostensibly, ink flows from the axial grooves to the circumferential grooves and then to the flexible material. Neither U.S. Pat. No. 4,458,399 nor U.S. Pat. No. 4,399,751 describe how the printing rolls are charged with ink.

Another U.S. Pat. No. 3,738,269 issued June 12, 1973 to Wagner describes the structure of a horizontal roller having a porous sleeve of ink-absorbing material with one or more reservoirs of ink within the sleeve. The reservoirs being free of vents to the atmosphere are stated to provide uniform inking.

Industries such as those handling unitary objects and consumer products, e.g., material handling industries, have been converting to various types of bar codes readable by scanning devices. Such devices permit the high speed passage of objects to which bar codes are appended, thus facilitating warehousing and inventory control. A major problem, however, has been the inability of prior printing devices to print the sharp bar code images on objects as they pass by a printer. Most prior art printers use dye based ink which tend to wick or feather, particularly on corrugated boxes, leaving printed codes very difficult or impossible to read by scanners.

Substituting pigment-based ink, a superior ink for quality printing even on the most difficult surfaces, has not proven to be viable since such inks are difficult to uniformily meter and transfer. The pigment-based inks having small particles of pigment suspended or emulsified in liquid as opposed to being in solution as in dye based inks, are prone to clog the transfer structure as the structure acts as a filter to the suspended pigment particles. This results in undesirable variations in print quality.

The aforementioned prior art devices also have complex structural requirements, are difficult to operate consistently, and do not provide the concise, continuous and uniform metering of ink, particularly ink of the pigmented type, required by scanning operations.

The microporous material of the type described and claimed in co-pending application Ser. No. 7,160 filed Jan. 27, 1987 assigned in part to the same assignee as the present invention is particularly suited to transfer pigmented ink at a constant rate. The material is initially ink impregnated and consistently transfers ink without substantial loss until the ink supply within is essentially depleted. Once depleted, the roll of microporous material is either discarded or impregnated again for subsequent use. At times it is preferable, however, to utilize such a material to its best advantages in continuous and extended use. The ink feed rollers of the prior art, as described above, lack the ability to provide an extended and precise metering of pigmented ink to the material for the detailed and prolonged printing required in some circumstances to permit reliable and extended printing of fast moving substrates with minimal decrease in impression intensity.

SUMMARY OF THE INVENTION

In accordance with the present invention, the ink dispensing roll comprises a first cylindical wall with a plurality of holes extending therethrough and a second wall which, together with the first cylindrical wall, define a thin cavity generally concentric with the first cylindrical wall. The holes communicate with the cavity which in turn communicate with an ink chargeable reservoir defined by the first cylindrical wall. The reservoir is positioned generally above the cavity and has a volume significantly greater than that of the cavity. Positioned about the first cylindrical wall over the holes is an ink impregnable sleeve capable of dispensing ink from an exterior surface and absorbing ink through an interior surface thereof. The microporous material and the differential in volumes and crosssectional areas between the reservoir and end cavity provide essentially uniform metering of ink from the reservoir to the exterior surface of the microporous material until the ink within the ink roller assembly is virtually exhausted.

Other features and advantages of the invention will become apparent from the following description taken together with the accompanying drawings and appended claims.

DETAILED DESCRIPTION OF PREFERRED EMBODIMENT

Figure 1:
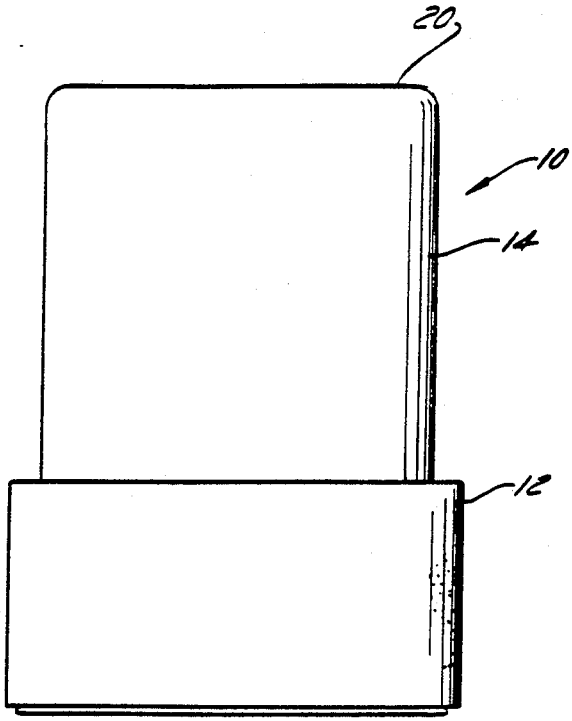
FIG. 1 is a side elevation view of an ink dispensing roller assembly constructed in accordance with one embodiment of the present invention.
Figure 2:
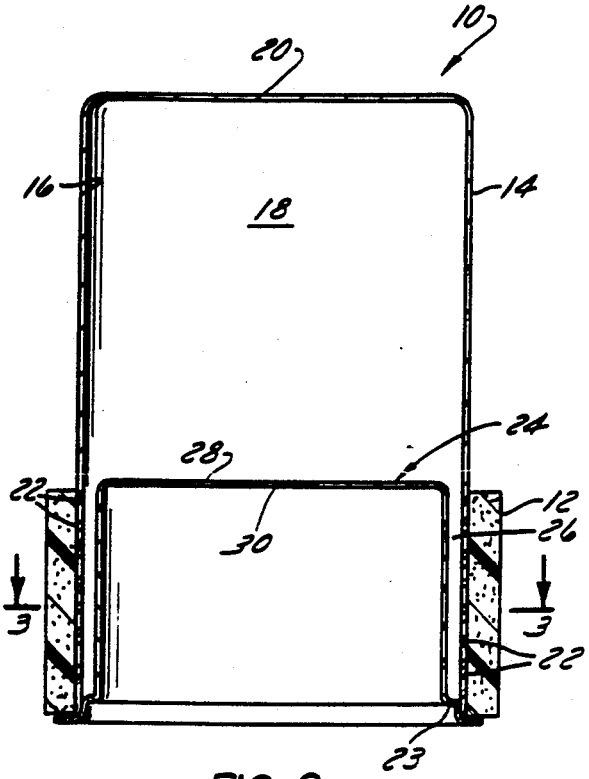
FIG. 2 is a central longitudinal sectional view of the roller assembly shown in FIG. 1 along lines 2—2.
Figure 3:
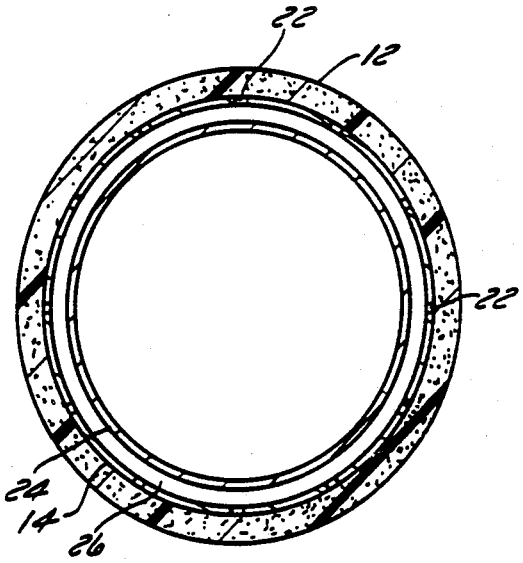
FIG. 3 is a vertical cross-sectional view of the roller assembly of FIG. 1 along lines 3—3.

FIGS. 1–3 illustrate an ink roller assembly 10 which is constructed in accordance with the present invention and which includes a sleeve 12 of flexible and resilient microporous material for the retention and transfer of ink as described below in detail.

Sleeve 12 is mounted about a cylindrical member 14 which maintains sleeve 12 in a tight fitting relationship. As best seen in FIG. 2, a cylindrical wall 16 of member 14 extends above sleeve 12 and forms an ink-holding cavity or reservoir 18 capped by integral cover 20. In the region adjacent sleeve 12, wall 14 is provided with a plurality of radially extending holes 22. For purposes of this invention the diameter of holes 22 is desirably 0.001 to 0.500 inches, and preferably 0.040 to 0.150 inches.

Positioned internally of wall 16 of member 14 in the region adjacent holes 22, is a second cylindrical member 24 defined by cylindrical walls 25 and integral cover 28 integrally connected to member 14 near the bottom edge by shoulder 23. Members 14 and 24 thus form an annular cavity 26 which is coaxial to sleeve 12 and has a longitudinal length approximately the same as sleeve 12. While the specific radial thickness of annular cavity 26 may be as large as suitable for a particular application, it is desirable in most situations for the radial thickness and volume thereof to be as small as possible to facilitate even transfer of ink and minimize remaining ink when the ink in reservoir 18 is depleted. The ratio of reservoir volume to cavity volume is at least 2 to 1 and preferably in the range of 5 to 1–20 to 1. FIG. 1 is essentially to scale and, as may be measured, the volume ratio is about 7 to 1. The radial thickness of cavity 26 is at least 0.050" and preferably 0.100" to 0.250". The exact radial thickness to be employed, however, depends primarily on the viscosity of the ink.

Shoulder 23 serves as a liquid tight seal and the sealed bottom to cavity 26 which at the upper end thereof opens into and communicates directly with reservoir 18. A hole 30 in cover 28 may be used to charge reservoir 18 with ink and thereafter suitably sealed.

The internal opening 32 formed by cylindrical member 24 is designed to receive bearing mount 34 and shaft 36 (shown in phantom in FIG. 3) for suitable rotation of the ink roller assembly 10 in use.

When used in operation, assembly 10 is charged with ink, preferably having pseudoplastic characteristics such as decreasing viscosity when shear increases. As depicted in FIG. 1, assembly 10 appropriate charged with ink is preferably mounted vertically with reservoir 18 positioned above the ink flows by gravity into annular cavity 26 and, due to hydraulic pressure provided by the differential in cross-sectional areas and capillary action, moves through holes 22 and into the pores of sleeve 12 thereby impregnating sleeve 12. As the ink within sleeve 12 is transferred, it is continuously and consistently replaced by the metering action of cavity 26 until the ink in reservoir 18 is exhausted so as to maintain as essentially zero order rate of loss of ink by sleeve 12.

It is important that the volume ratio of reservoir 18 to cavity 26 be maintained large and the radial thickness of the cavity be kept small for several important reasons. The holes 22, which provide ink communication with sleeve 12, are in wall 14 which, along with wall 16, defines the narrow radial thickness of cavity 26. The ink is constantly caused by gravity to flow from reservoir 18 into cavity 26 and the hydraulic pressure exerted by the ink being forced into a smaller cross-sectional area provides a constant metering of the ink through holes 22 into sleeve 12. Additionally, cavity 26, at any point in time, contains little ink compared to reservoir 18. In other words, cavity 26, because of its dimensional characteristics, does not act as a reservoir, but instead acts as an essential component to facilitate the constant transfer of the ink from reservoir 18 to sleeve 12. Such dimensional characteristics permit consistent ink flow even when reservoir 18 is nearing depletion. Once ink in reservoir 18 is depleted, the entire ink supply within assembly 10 is virtually exhausted.

Additionally, the total horizontal cross-section area of reservoir 18 is substantially greater than that of annular cavity 26 providing increased hydrostatic pressure at holes 22. It is believed that this pressure, coupled with the strong capillary action of the microporous material (as described below) comprising sleeve 12, enhances the uniform metering action which is enjoyed by the ink roller assembly of the present invention.

It should be understood that while the description above is directed toward a preferred embodiment in which reservoir 18 is positioned above cavity 26 as within a printing apparatus, other positioning arrangements may be employed depending upon the particular application. If desired, a horizontal arrangement could be employed as long as effect of gravity is produced through a pumping arrangement. The volume and cross-sectional area differentials must remain however.

Although FIGS. 1 through 3 depict an ink roller assembly of the disposable or integral type, the assembly may be advantageously constructed so as to have a separate cylinder with the reservoir which, when exhausted, can be replaced by another cylinder.

The microporous material comprising sleeve 12 may be prepared by a method including as its initial step mixing from 8 to 50% by weight of a plastic powder with from about 10 to 90% by weight of a water-soluble salt and from about 10 to 50% by weight of a water-soluble, polar organic material. This mixing preferably takes place in the absence of external heating, but under vacuum. The purpose of the mixing is to intimately mix the plastic, water-soluble salt and the polar organic material. After the mixture is intimately mixed, it is placed in a mold and heated with any of a variety of heating means to a temperature above the melting temperature of the plastic. This allows the plastic to melt and form a cohesive structure around the salt and polar organic material. Following this melting step, the structure is allowed to cool and then the salt and polar organic material are leached from the structure, preferably with water. The structure is dried and then impregnated with from about 40 to about 90% by weight of an ink. In the detailed description of this method which follows, amount limitations should be considered approximate.

The first step of the preceding method of forming the microporous material used in the present invention comprises mixing from 8 to 50% by weight of the plastic powder with the water-soluble salt and the water-soluble, polar organic material. The plastic powder preferably has an average particle size within the range of from 1 to 80 microns. Better results are obtained when the plastic used to form the structure is impervious to solvents typically used in formulating printing inks. Suitable plastics are the thermoplastic polymers such as polyvinyl chloride, polyvinyldene chloride, polystyrene, acrylonitrile-butadiene-styrene polymers, butadiene-styrene polymers, acrylate polymers and copolymers such as ethylacrylate, butylacrylate, etc., polyvinyldiene fluoride, polyethylene, polypropylene, polyethylene vinyl acetate copolymers, polyamides, nylons, polychlorotrifluoroethylene, polyacrylonitrile, alkyl methacrylate polymers, such as polymethyl methacrylate, etc., cellulose acetate, acetals, polycarbonates, and the like. Preferred polymers include polyethylene, polypropylene, polyethylene-vinylacetate copolymers, and mixtures thereof. Although any grade of polyethylene and polypropylene can be used, it is preferred to use high density polyethylene, linear low density polyethylene, mixtures of high density polyethylene with a polyethylene vinylacetate and mixtures of linear low density polyethylene with polyethylene vinylacetate. The preferred amount of plastic powder usable in the method of the present invention is from about 10 to about 25% by weight, based on the total weight of the initial mixture including plastic powder, water-soluble salt and water-soluble, polar organic material.

The second ingredient of the mixture is a water-soluble salt. The salt used can be any water-soluble salt which is miscible with the plastic powder to be utilized and the water-soluble, polar organic material. Inorganic salts, particularly alkali metal salts, are preferred. Such salts include sodium nitrate, sodium chloride and the like, of which sodium nitrate is preferred. The more water-soluble the salt, the easier it is to remove with the solvent of choice, water. Generally, from about 10 to 90% by weight of the water-soluble salt is used in the initial mixture. The greater the amount of water-soluble salt used, the more open or porous the microporous structure becomes. Generally, it is preferred to use between about 40 and 65% by weight salt, although in certain situations, where a very porous ink roll is required, up to 90% wt. can be utilized.

The third component is a water-soluble, polar organic material. As such material, an alcohol such as an alkanediol can be used, preferably one having from 2 to 6 carbon atoms. The boiling point of the polar organic material must be higher than the melting point of the particular plastic to be used because the polar organic material must remain in a liquid state while the plastic is being melted to form the microporous cohesive structure. Suitable alkanediols include propylene glycol, 1,4-butanediol, 1,5-pentanediol, 1,6-hexandiol and the like. Generally, from 10 to 50% by weight of the water-soluble material is used, and preferably from 20 to 40% by weight, based on the total weight of the initial mixture.

The water-soluble, polar organic material improves the processing of the microporous structure at room temperature. However, the prime reason for using the water-soluble, polar organic material is to enhance the flow characteristics of the high density image-producing ink from the microporous structure which is formed. The water-soluble, polar organic material coats the salt particles and smooths (round) their rough edges during the molding process to take place. This allows the formation of a microporous structure having a smooth, rounded internal surface which dramatically lowers the internal surface area of the structure. Microporous structures with a high internal surface area act to hold the ink within the structure and the structure may actually filter the pigment out of the ink, a circumstance to be avoided. Thus, proper careful control permits an ease of tailoring appropriate surface characteristics.

The use of the water-soluble, polar organic material acts on the molded plastic to form an opencelled structure of interconnected, often spheroidal or ovoid cavities with smooth internal surfaces essentially free of fibrous type projections. This structure has a "0" (i.e., zero) order ink loss rate rather than a first order ink loss rate, as is typical of other microporous structures. The practical effect of a "0" order ink loss rate is that the structure dispenses substantially the same amount of ink upon repetitive contact with a surface over most of its useful life, i.e. the same amount between 2000–3000 impressions as between 8000–9000 impressions.

A method for making microporous material suitable for use in the invention is as follows. The plastic powder, salt and water-soluble, polar organic material are mixed together in any order to form a tacky material or thick viscous paste. The mixing step is carried out over a period of at least 10 minutes. This mixing is to be done without application of heat, but preferably under subatmospheric (e.g., vacuum) or such other conditions so that air is not introduced into the mixture. The thick mixture is then placed in an appropriate mold by pumping, manual transfer or the like. Suitable molds can include cylindrical pipe shaped molds, bar molds, etc. The plastic is then heated and cooled. It becomes firm and hard, and is then removed from the mold. After molding and cooling, the salt and material are leached out. One method of leaching is to place the structure in water and allow it to stand. Depending upon the temperature and the movement of the water, the salt and water-soluble material can be leached out of the structure in as little as one hour. After the water and soluble material and salt are removed, a pliable, microporous structure remains. This structure is then dried and the high density image-producing ink, as described in detail below, is impregnated therein.

In one application of the preceding general method, the powdered plastic, water-soluble, polar organic material and water-soluble salt are mixed from 10 to 45 minutes to form an intimate mixture of the components. The mixing also rounds the sharp edges of the particles during molding. Mixing can be accomplished by conventional mixing equipment without supplying heat during the mixing step. The resulting material can be easily handled.

After the mixture of plastic, water-soluble material and smoothed water-soluble salt particles is formed, it is then transferred by any conventional means to a mold, such as pumping if the mixture is pumpable, or manual transfer. The mold can be of any desired shape. For forming ink rolls, a mold of 4" outside diameter and 3.5" inside diameter by 12" in length is suitable.

After the mixture is placed in the mold, the mold and mixture are heated by conventional means, for instance, a hot oil bath, microwave radiation or forced air. The exact temperature depends on the components used. The temperature should be above the melting temperature of the plastic but below the boiling point of the water-soluble, polar organic material. For typical mixtures, a temperature within the range of 170° to 300° F. maintained for 10 to 40 minutes is suitable.

The mold is then allowed to cool and the resulting structure is removed from the mold. The structure is then placed in a solvent, preferably an aqueous solvent such as water, to leach out the water-soluble, polar organic material and the water-soluble salt. Any conventional leaching method may be used. One convenient method is to use warm (120°–140° F.) water which is agitated. The structure is left for up to 24 hours, although shorter periods can be used, such as 4 to 8 hours for a structure of smaller size. The water can be changed periodically to decrease the leaching time.

After leaching, the structure is dried by any conventional means, such as a forced air oven. A drying period of 20–24 hours at 120°–140° F. will typically dry the structure and render it ready for use as a sleeve in an ink dispensing roller assembly. Occasionally, it may further be desirable to grind the outer surface of the structure to adjust the dimensions of the structure to a desired size. This grinding has no substantial effect on the release rate of the ink from the structure if adjusted. The exterior surface of the structure thus prepared (with or without grinding) lacks a skin which must be removed, or through which the ink must permeate.

Figure 4:
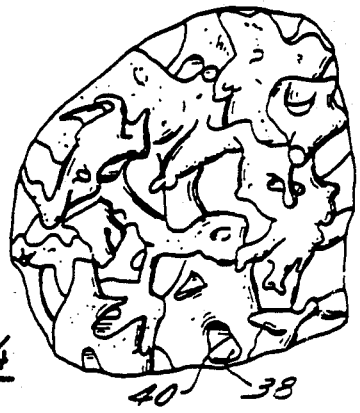
FIG. 4 represents a magnified section of the microporous sleeve material as drawn from a photograph.

The average pore size of microporous material is at least 10 microns, generally in the range of approximately 10 to 250 microns. Within the 10–250 micron range, individual pore sizes are seldom more than 50 microns larger or smaller than the average pore size. Pores comprise interconnected cavities or cells, generally of spheroidal or ovoid shape, or of other shapes, which are smooth-walled and rounded. This configuration is depicted in FIG. 4, a drawing rendition of a magnified portion of a surface of sleeve 12. As will be noted the cavities or pores shown generally as numeral 38 have rounded walls (shown generally as 40) which give the pores 38 a spheroidal or oviod shape.

Pores smaller than 10 microns are undesirable because particles of pigment in the ink have particle sizes typically up to about 10 microns, and may thus become lodged in a pore and clog it. Inks preferable for use in the invention have an average pigment particle size of less than about 5 microns, particularly less than about 3 microns, for this reason. As referred to herein, pore and particle sizes refer to the diameter thereof, or to the largest dimension thereof if not spheriodal.

The following example, which is for the purpose of illustration and is not in any way to be construed as limiting, depicts one method of forming the microporous material.

EXAMPLE

To a Ross Interplanetary mixer is added 60.0 pounds of sodium nitrate, particle size 50–150 microns, 15.0 pounds of FE-532 Microthene plastic powder, 10–80 microns, 91% Ethylene/9% vinylacetate copolymer from USI Chemical, and 20.0 pounds of 1,4-butanediol. The above is mixed at low speed under vacuum for 10 minutes. At that time, an additional 5.0 pounds of 1,4-butanediol is added and the mixture is mixed at high speed for 15 minutes under vacuum. The resulting slurry is removed from the mixer and pumped to an aluminum mold. The mold is a cylinder having a core and end caps.

The mold forms a part having a 4" outside diameter and a 3.5 inch inside diameter by 12 inches long. The mold is sealed and placed in a hot oil bath at 280° F. for 20 minutes. After heating, the mold is removed and placed in water for 15 to 20 minutes to cool. The part is then removed from the mold and placed in agitated warm (120°–140° F.) water. After 1 hour, the water is changed and the part is left to soak for an added 6 hours. The part is then removed from the water and dried in a forced air oven at 120°–140° F. for 24 hours. After removal from the oven, the part is a soft microporous structure ready to be inked and mounted about cylinder 14 in a tight fit relationship.

Thus, the positioning of a sleeve of material, as described above, about the outer cylindrical member 14 and the placement of members 14 and 24 so as to form the thin annular cavity 26 communicating with ink charged reservoir 18 are important to the proper operation of the invention. Additionally, the volume of the cavity in relationship to the reservoir is important to the controlled metering of ink. The cavity and the juxtaposed reservoir ensures a uniform and constant supply of ink to the sleeve and minimizes variables associated with other prior art ink roller assemblies. The ink supply meters under gravity (or a pumping arrangement) into the cavity controlled by the radial width/small volume of the cavity, and moves by gravity or pumping arrangement and capillary action, consistently and uniformly, through the holes in the first member. It is then transferred by the microporous structure of the sleeve to the outer periphery thereof with minimum rate of transfer loss for contact with a transfer substrate in a printing operation. The ink will continue to move in this manner as long as the reservoir contains ink. Because the volume of ink held by the cavity is small compared to the volume of ink contained by the reservoir, the cavity will be uniformly filled and in contact with the microporous ink-retaining material until the supply of ink is virtually exhausted.

While a preferred embodiment of the invention has been shown and described, it will be understood that the invention may take on other embodiments without departing from the scope and spirit of the appended claims.

We claim:

1. An ink dispensing roll, comprising:

(a) a first hollow and substantially cylindrical member with a plurality of holes extending therethrough only in a defined region located near one end of said first member;

(b) a second substantially cylindrical member defining with said first member an annularly shaped cavity volume extending along the entire width of said defined region and terminating substantially at the end of said region and directed away from said one end of said first member;

(c) said first member also defining a reservoir volume for ink positioned in fluid communication with said cavity volume, said reservoir volume being substantially greater than said cavity volume; and (d) ink impregnable means secured to and around the outer surface of said first cylindrical member only over said defined region for absorbing ink flowing through said holes from said cavity volume into the interior of said ink impregnable means and for dispensing ink from an exterior surface of said ink impregnable means upon contact with an ink receiving surface.

2. The ink dispensing roll of claim 1, wherein said cavity is of annular shape and said reservoir communicates with said cavity at an end portion thereof.

3. The ink dispensing roll of claim 2, wherein said reservoir is generally cylindrical and is coaxial with said cavity.

4. The ink dispensing roll of claim 1, wherein said ink impregnable means comprises a tubular sheath of an ink impregnated, microporous material disposed in close conforming contact with said cylindrical wall.

5. The ink dispensing roll of claim 1 in which said reservoir volume is at least twice said cavity volume.

6. The ink dispensing roll of claim 5 in which a ratio of said reservoir volume to said cavity volume is between about 5 to 1 and 20 to 1.

7. The ink dispensing roll of claim 5 in which said cavity has a radial thickness of about 0.050" to 0.500".

8. The ink dispensing roll of claim 7 in which said annular cavity has a radial thickness of about 0.100" to 0.125".

9. An ink dispensing roll capable of uniformly metering and transferring ink to a surface comprising (a) a first hollow cylindrical member and an integral first top enclosing one end of said first member, said first member having a plurality of holes extending therethrough only in a defined region near the other end of said first member;

(b) a second cylindrical member and an integral second top positioned within said first cylindrical member, said first and second members defining an annular cavity therebetween and extending the width of said defined region and terminating at the end of said region toward said first top, said members being sealed together along a lower region of each, said first and second tops and said first member defining a reservoir capable of receiving ink and in communication with said annular cavity, said reservoir having a volume at least twice the volume of said annular cavity; and (c) ink impregnable means mounted about said first cylindrical wall only along the defined region thereof for uniformly transferring ink moving from said reservoir into said cavity and through said plurality of holes to an exterior surface in contact with said ink impregnable means.

10. The ink dispensing roll of claim 9 in which said first and second cylindrical walls are aligned substantially coaxially.

11. The ink dispensing roll of claim 9 in which a ratio of said reservoir volume to said annular cavity volume is between about 5 to 1 and 50 to 1.

12. The ink dispensing roll of claim 11 in which said annular cavity has a radial thickness of between about 0.050" to 0.500".

13. The ink dispensing roll of claim 12 in which said annular cavity has a radial thickness of between about 0.100" to 0.250".

* * * * *